US007315136B1

(12) United States Patent
Chen et al.

(10) Patent No.: US 7,315,136 B1
(45) Date of Patent: Jan. 1, 2008

(54) PROTECTION APPARATUS AND MULTI-LAMP DRIVING SYSTEM USING THE SAME

(75) Inventors: Wen-Sheng Chen, Taipei (TW); Chien-Lung Kuo, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 11/783,370

(22) Filed: Apr. 9, 2007

(30) Foreign Application Priority Data

Nov. 7, 2006 (TW) ..... 95219645 U

(51) Int. Cl.
*H05B 41/16* (2006.01)

(52) U.S. Cl. ..... 315/282; 315/274; 315/291; 315/307; 315/312

(58) Field of Classification Search ..... 315/274–289, 315/291, 307, 312, 324, 323
See application file for complete search history.

(56) References Cited

U.S. PATENT DOCUMENTS

2005/0285548 A1* 12/2005 Moyer et al. ..... 315/312
2006/0119286 A1* 6/2006 Huang et al. ..... 315/291

* cited by examiner

*Primary Examiner*—Tuyet Vo
(74) *Attorney, Agent, or Firm*—Bacon & Thomas, PLLC

(57) ABSTRACT

A multi-lamp driving system includes a driving apparatus and a current balancer having detection nodes. The protection apparatus includes at least a detection unit and a determining unit. The detection unit includes first impedance devices and a second impedance device. A first end of each first impedance device is coupled with the corresponding detection node. The second impedance device is coupled with a second end of each first impedance device. The cross-voltage between a first end and a second end of the second impedance device is relative to the sum of the voltage level of the detection nodes coupled with the first impedance devices. The determining unit coupled with the second impedance device of the detection unit outputs a protection signal to disable the driving apparatus according to the cross-voltage between the first and second ends of the second impedance device when at least one of the lamps malfunctions.

20 Claims, 8 Drawing Sheets

PROTECTION APPARATUS AND MULTI-LAMP DRIVING SYSTEM USING THE SAME

This application claims the benefit of Taiwan application Serial No. 95219645, filed Nov. 7, 2006, the subject matter of which is incorporated herein by reference.

BACKGROUND OF THE INVENTION

1. Field of the Invention

The invention relates in general to a protection apparatus and a multi-lamp driving system using the same, and more particularly to a protection apparatus with high sensitivity and low cost and a multi-lamp driving system using the same.

2. Description of the Related Art

Recently, there are some patents which disclose multi-lamp driving systems of large-size displays and current balancers thereof for detecting the malfunctioning lamps in order to reduce damage to the components. The disclosed multi-lamp driving system of the large-size display and the current balancer thereof cooperate with a protection circuit to provide better protection.

Please referring to FIG. 1, a conventional multi-lamp driving system is illustrated in FIG. 1. A ring balancer 110 disclosed in European Patent No. 1,671,521 is applied to the multi-lamp driving system 100. A protection circuit 120 is for malfunction protection (open circuit, short circuit or overload) of lamps. However, the ring balancer 110 is disposed at a high voltage end of the lamps L1~Lk. When one or more of the lamps malfunction, the sensitivity of signals transmitted from stray capacitors C11~Cn2 to detection node voltages V1~Vk is insufficient. The protection circuit 120 malfunctions easily and is not able to output a protection signal S to control a driving circuit or shut down the power.

In a floating type current balancer disclosed in European Patent No. 1,581,030 or a Zaulas type current balancer disclosed in Japan Patent No. 2004-335443, a detection diode is used in a protection circuit. When one of the lamps malfunctions, a corresponding balance transformer in the current balancer generates extremely high voltage. Therefore, the detection diode has to sustain high voltage and therefore costs more. Furthermore, a large-size display needs a large area light source. In other words, more lamps are needed, and the number of detection diodes is increased accordingly. As a result, the cost is increased as well.

Therefore, it is very important to reduce the cost of the protection circuit and increase the sensitivity of detecting the malfunctioning lamp.

SUMMARY OF THE INVENTION

The invention is directed to a protection apparatus and a multi-lamp driving system using the same. A general impedance device is used in the protection apparatus to replace a high voltage diode. Even when a current balancer is disposed at a high voltage side of the lamps, the protection apparatus still has much higher sensitivity in detecting the malfunctioning lamp. Therefore, the protection apparatus of the present invention decreases the manufacturing cost effectively, and the multi-lamp driving system using the same provides better protection.

According to the present invention, a protection apparatus used in a multi-lamp driving system is provided. The multi-lamp driving system includes a driving apparatus and a current balancer. The driving apparatus is for driving several lamps. The current balancer is for balancing the current flowing through each of the lamps and includes several detection nodes. The protection apparatus includes at least a detection unit and a determining unit. The at least one detection unit includes several first impedance devices and a second impedance device. A first end of each first impedance device is coupled with the corresponding detection node. The second impedance device is coupled with a second end of the first impedance device. The cross-voltage between a first end and a second end of the second impedance device is relative to the sum of the voltage level of the detection nodes coupled with the first impedance devices. The determining unit is coupled with the second impedance device of the at least one detection unit. When determining at least one of the lamps malfunctions according to the cross-voltage between the first end and the second end of the second impedance device, the determining unit outputs a protection signal to disable the driving apparatus.

According to the present invention, a multi-lamp driving system is provided. The multi-lamp driving system includes a driving apparatus, a current balancer and a protection apparatus. The driving apparatus is for driving several lamps. The current balancer is for balancing the current flowing through each of the lamps and includes several detection nodes. The protection apparatus includes at least a detection unit and a determining unit. The at least one detection unit includes several first impedance devices and a second impedance device. A first end of each impedance device is coupled with the corresponding detection node. The second impedance device is coupled with a second end of each impedance device. The cross-voltage between a first end and a second end of the second impedance device is relative to the sum of the voltage level of the detection nodes coupled with the first impedance devices. The determining unit is coupled with the second impedance device of the at least one detection unit. When determining at least one of the lamps malfunctions according to the cross-voltage between the first end and the second end of the second impedance device, the determining unit outputs a protection signal to disable the driving apparatus.

The invention will become apparent from the following detailed description of the preferred but non-limiting embodiments. The following description is made with reference to the accompanying drawings.

DETAILED DESCRIPTION OF THE INVENTION

First Embodiment

Figure 2:
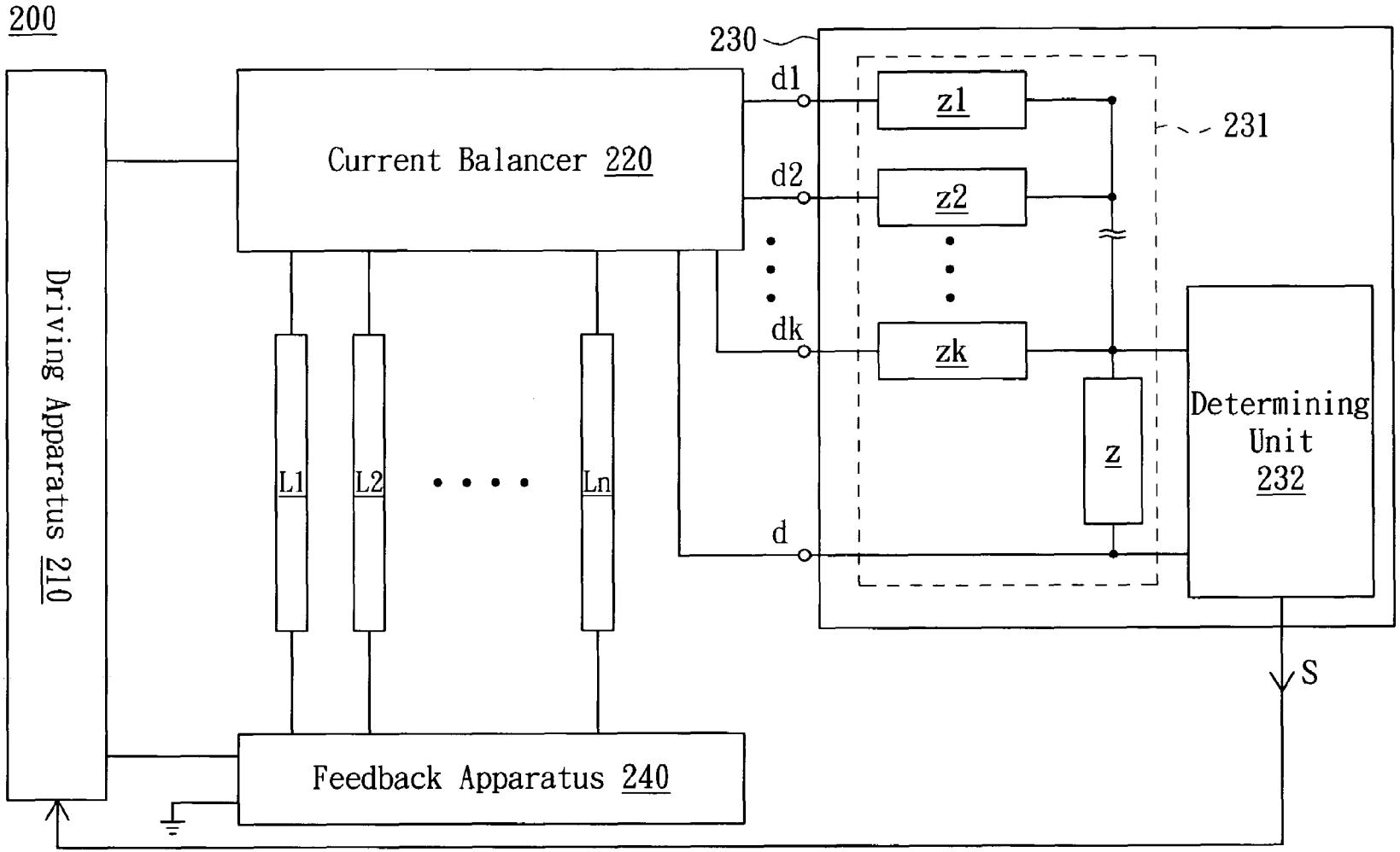
FIG. 2 is a block diagram of a multi-lamp driving system according to a first embodiment of the present invention.

Please referring to FIG. 2, a block diagram of a multi-lamp driving system according to a first embodiment of the present invention is illustrated in FIG. 2. The multi-lamp driving system 200 includes a driving apparatus 210, a current balancer 220, a protection apparatus 230 and a feedback apparatus 240. The driving apparatus 210 including a PWM control IC, a full bridge module and a high voltage transformer is for driving several lamps L1~Ln. N is a positive integer. The lamps L1~Ln are cold cathode fluorescent lamps (CCFL) for example. The current balancer 220 includes several detection nodes d1~dk, and k is a positive integer. In the first embodiment, the current balancer 220 is disposed at a high voltage end of the lamps L1~Ln as an example.

The protection apparatus 230 includes at least a detection unit 231 and a determining unit 232. The detection unit 231 includes several first impedance devices z1~zk and a second impedance device z. The first impedance device zi is coupled with the corresponding detection node di, and i=1~k. A first end of the second impedance device z is coupled with second ends of the first impedance devices z1~zk. In the first embodiment, the current balancer 220 further includes a reference node d. A second end of the second impedance device is coupled with the reference node d. Though the chosen detection nodes d1~dk and the reference node d (illustrated as follow), the cross-voltage between the first end and the second end of the second impedance device z is relative to the sum of the voltage level of the detection nodes d1~dk. Therefore, when at least one of the lamps L1~Ln malfunctions, the variation of the voltage level of the detection nodes d1~dk is reflected in the cross-voltage between the two ends of the second impedance device z.

The determining unit 232 is coupled with the second impedance device z. When determining at least one of the lamps malfunctions according to the cross-voltage between the two ends of the second impedance device z, the determining unit 232 outputs a protection signal S to disable the driving apparatus 210. As a result, the driving signal is not sent to the malfunctioning lamp for protection.

Figure 3A:
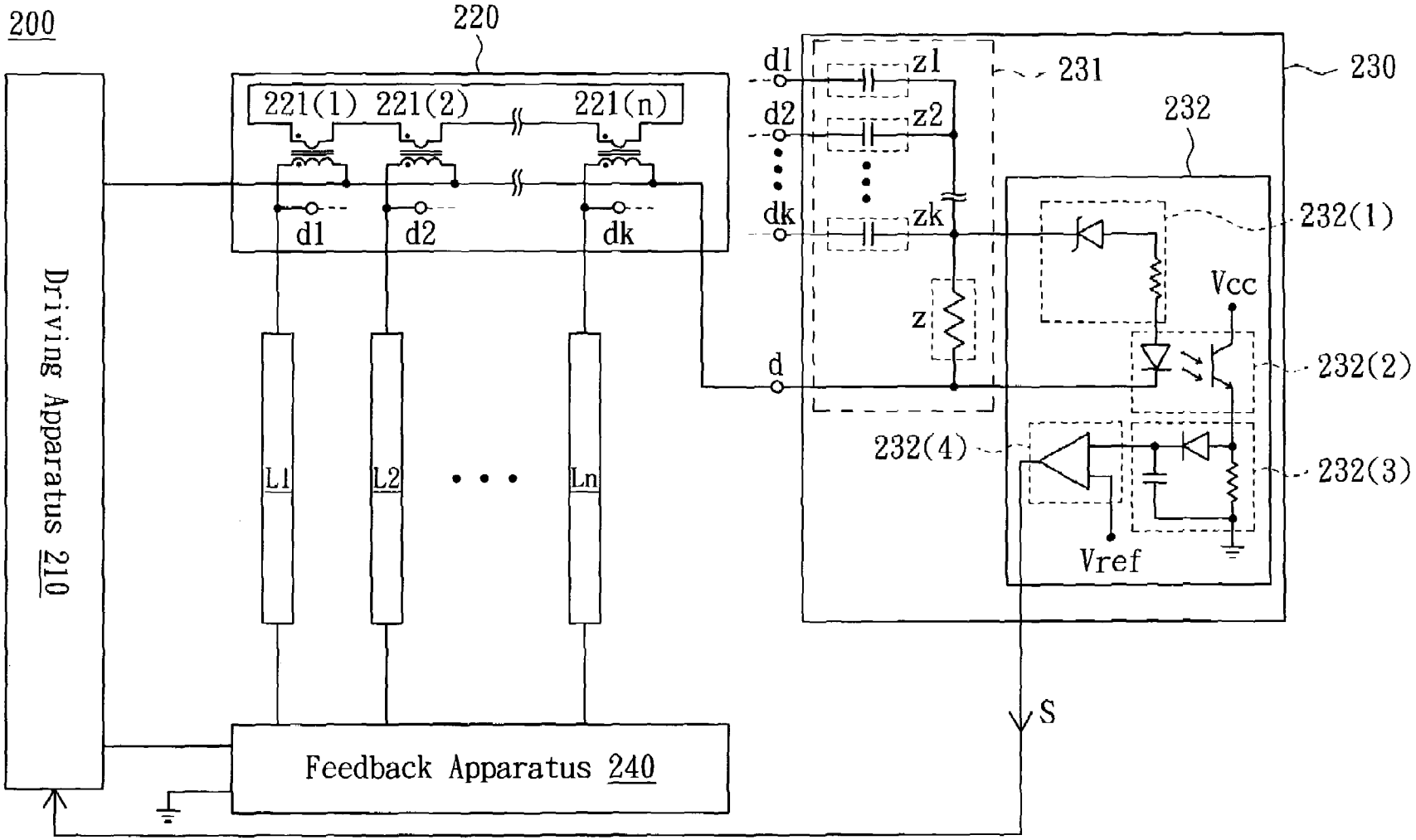
FIG. 3A is a first type of the circuit diagram of the multi-lamp driving system in FIG. 2.

Please referring to FIG. 3A, a first type of the circuit diagram of the multi-lamp driving system in FIG. 2 is illustrated in FIG. 3A. In FIG. 3A, the current balancer 220 is a ring balancer for example. Also, the current balancer 220 includes several balance transformers 221(1)~221(*n*). The detection nodes d1~dk are at one end of a primary side (an output end coupled with the driving apparatus 210) of the balance transformers 221(1)~221(*n*). A common node is at another end of the primary side of the balance transformers 221(1)~221(*n*) and used as the reference node d. The first impedance devices z1~zk and the second impedance device z are preferably inductance devices, capacitance devices or resistance devices according to the need. For example, the first impedance devices z1~zk are capacitance devices and have the same impedance, and the second impedance device z is a resistance device in FIG. 3A.

Moreover, the determining unit 232 includes a clipper 232(1), an isolation circuit 232(2), a peak detector 232(3) and a comparator 232(4). A high voltage side of the isolation circuit 232(2) is coupled with the first end and the second end of the second impedance device z through the clipper 232(1). Two input ends of the comparator 232(4) are coupled with a reference voltage Vref and a low voltage side of the isolation circuit 232(2) through the peak detector 232(3) respectively.

Figure 1:
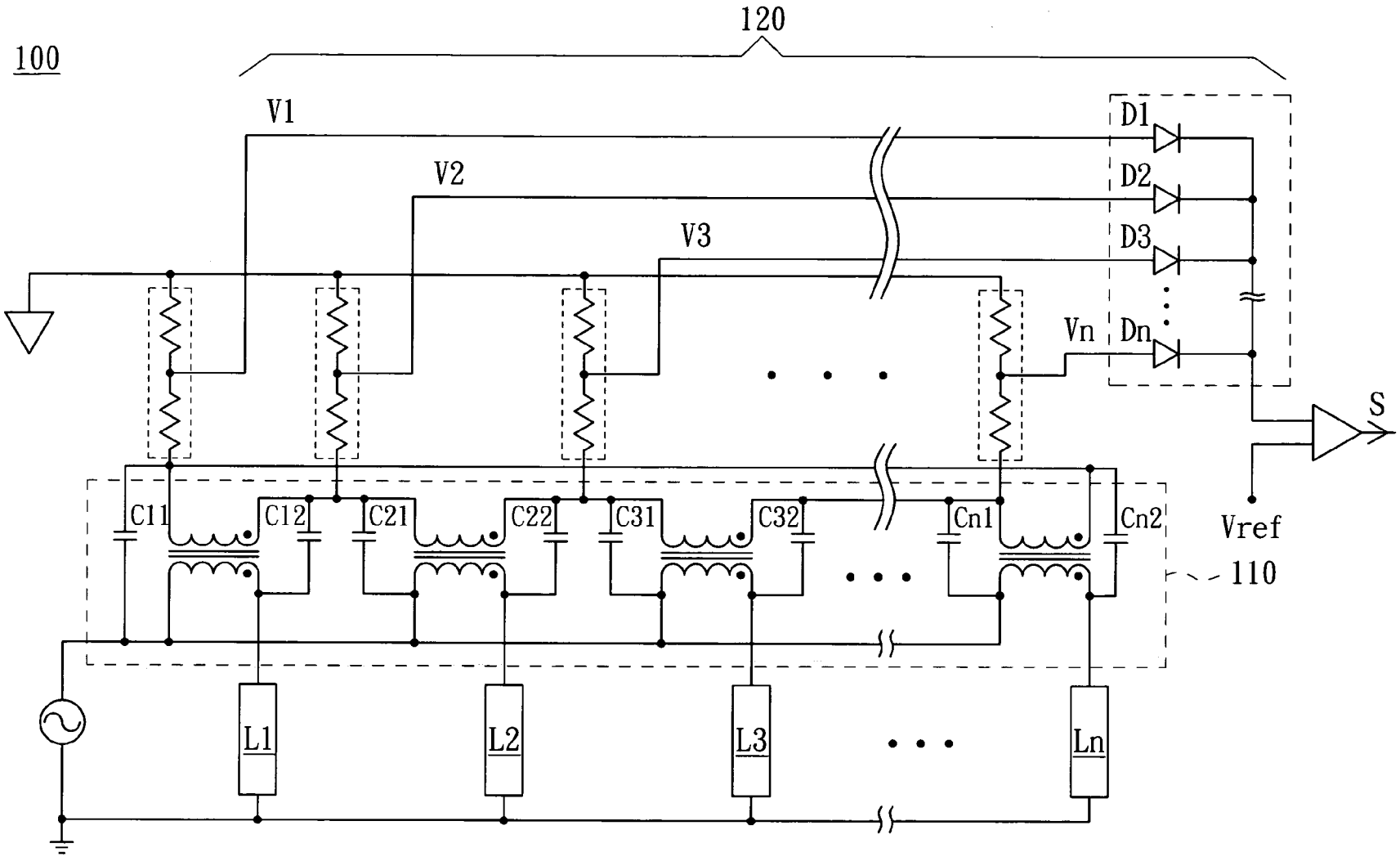
FIG. 1(PRIOR ART)
FIG. 1 (Prior Art) illustrates a conventional multi-lamp driving system.

When the lamps L1~Ln function normally, the voltage level of the detection nodes d1~dn is about 10V. When one of the lamps malfunctions, the voltage level of the corresponding detection node reaches 1000V in a very short time. The sensitivity of the cross-voltage variation of the second impedance device z of the present invention is 100 times larger than the conventional one of the protection circuit in FIG. 1. Meanwhile, the isolation circuit 232(2) of the determining unit 230 transforms the input signal from the high voltage side to the low voltage side for a lower-level low voltage circuit. As a result, the lower-level circuit does not interfere with the upper-level circuit. In FIG. 3A, a photo coupler is used as the isolation circuit 232(2). However, an isolation transformer can be used as the isolation circuit 232(2) in other embodiments. When the isolation circuit 232(2) outputs a voltage waveform corresponding to the malfunctioning lamp from the low voltage side, the voltage waveform is transmitted to an input end of the comparator 232(4) through the peak detector 232(3). Also, when the level is greater than the reference voltage Vref of another input end, the comparator 232(4) outputs the protection signal S to disable the driving apparatus 210.

As shown in FIG. 3A, the clipper 232(1) increases the difference between the cross-voltage of the second impedance device z when the lamps functioning normally and the one when one of the lamps malfunctioning through a zener diode. The peak detector 232(3) outputs the maximum level of the received voltage waveform by charging the capacitance through the diode. As a result, the sensitivity of the protection apparatus 230 is increased. However, the inner circuits of the above components are not limited to the drawings. Moreover, the clipper 232(1) can also be disposed at the low voltage side of the isolation circuit 232(2).

Figure 3B:
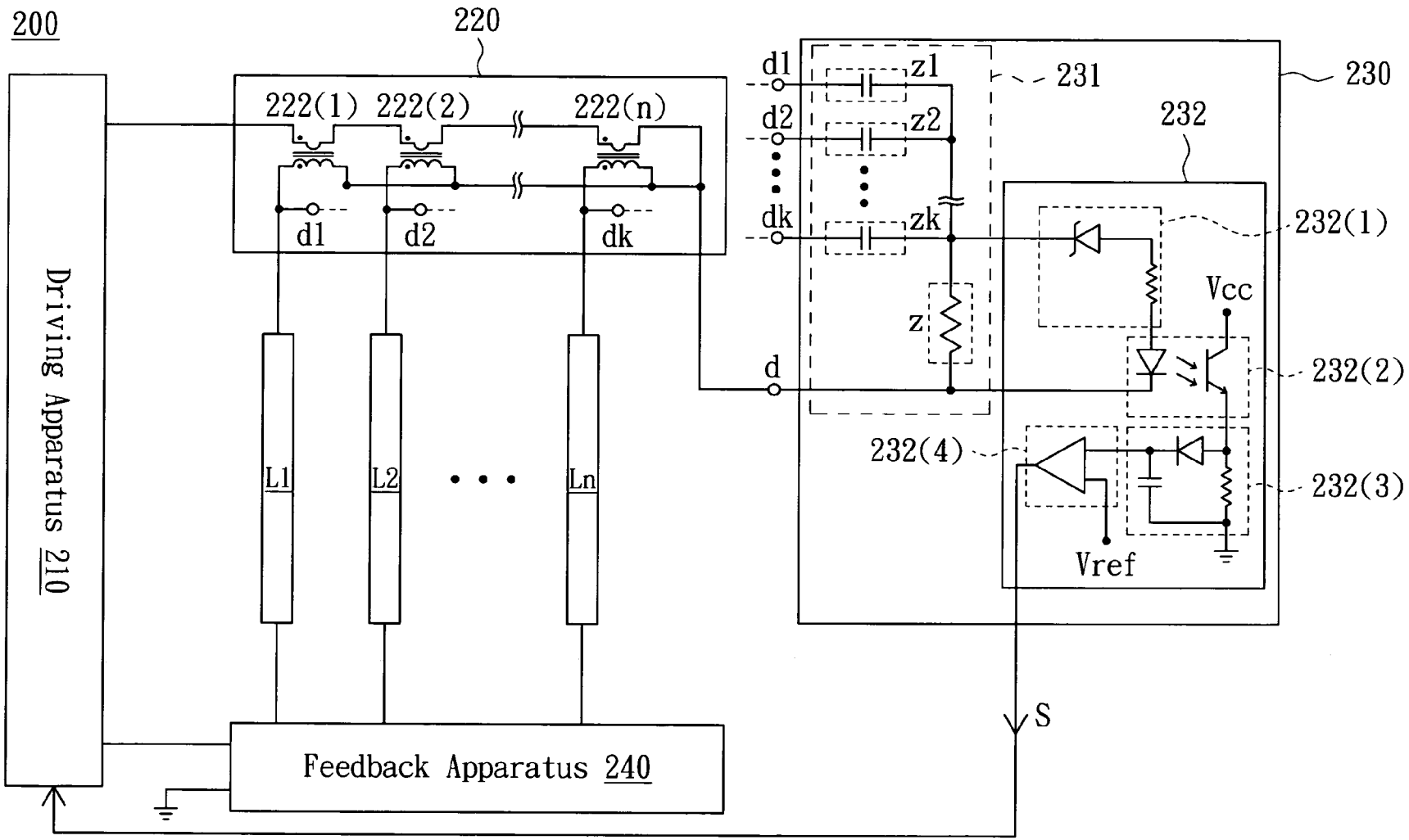
FIG. 3B is a second type of the circuit diagram of the multi-lamp driving system in FIG. 2.

Please referring to FIG. 3B, a second type of the circuit diagram of the multi-lamp driving system in FIG. 2 is illustrated in FIG. 3B. The difference between FIG. 3B and FIG. 3A is that the primary sides of the balance transformers 222(1)~222(*n*) of the current balancer 220 are in series connection (as disclosed in Taiwan Patent No. M291174). The detection nodes d1~dk (similarly k=n) are at one end of the secondary sides of the balance transformers 222(1)~222(*n*). The common node of another end of the secondary sides of the balance transformers 222(1)~222(*n*) can be used as the reference node d.

Figure 3C:
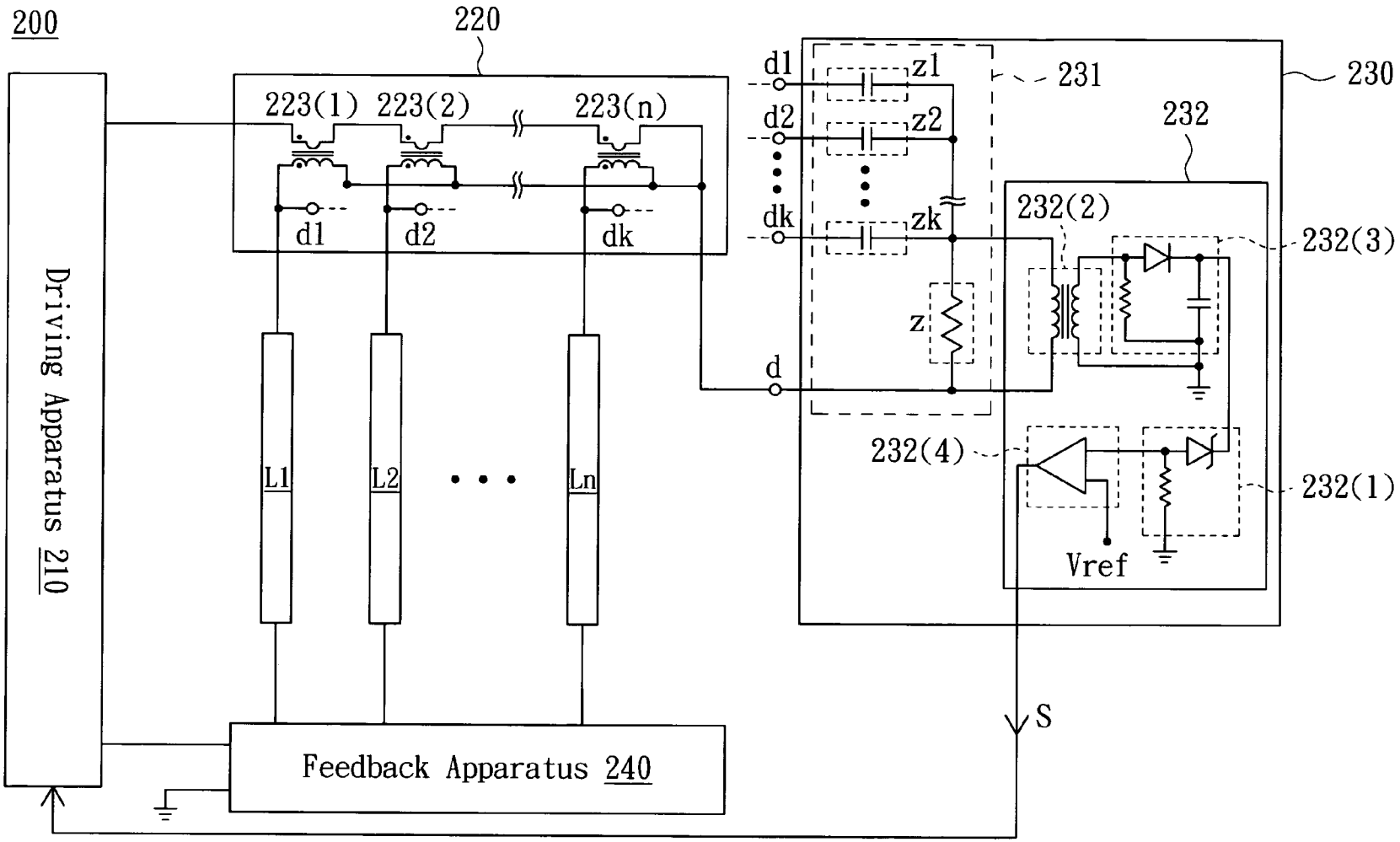
FIG. 3C is a third type of the circuit diagram of the multi-lamp driving system in FIG. 2.

Please referring to FIG. 3C, a third type of the circuit diagram of the multi-lamp driving system in FIG. 2 is illustrated in FIG. 3C. The difference between FIG. 3C and FIG. 3B is that an isolation transformer is used in the isolation circuit 232(2). Also, the clipper 232(1) is coupled between the peak detector 232(3) and the comparator 232(4).

Figure 3D:
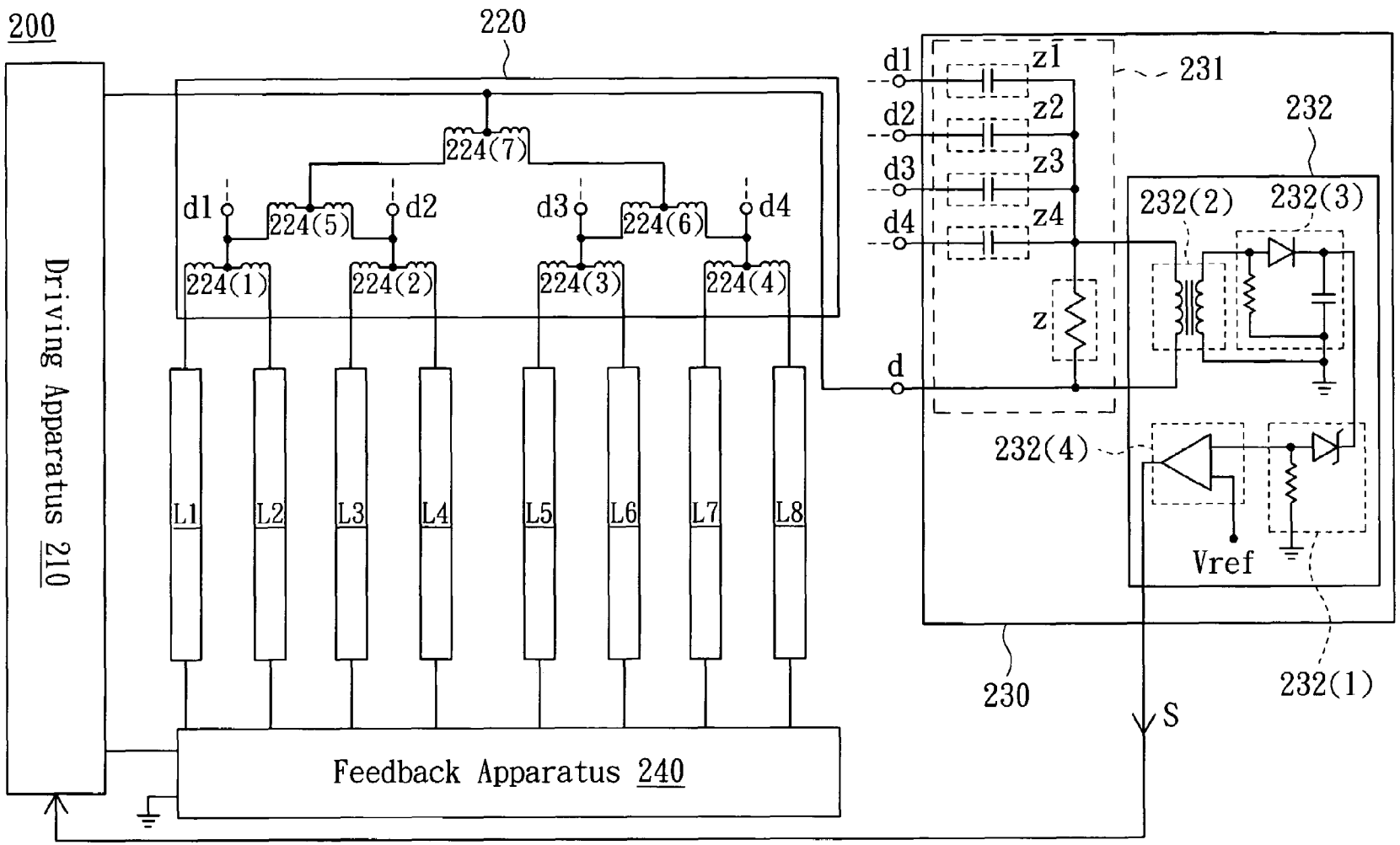
FIG. 3D is a fourth type of the circuit diagram of the multi-lamp driving system in FIG. 2.

Please referring to FIG. 3D, a fourth type of the circuit diagram of the multi-lamp driving system in FIG. 2 is illustrated in FIG. 3D. The difference between FIG. 3D and FIG. 3C is that the current balancer 220 is a Zaulas type current balance as an example and includes several balance transformers 224(1)~224(7). Furthermore, the common node of the primary side and the secondary side of the balance transformer 224*i*) is used as the detection node di (i=1~4). The common node (coupled with the output end of the driving apparatus 210) of the primary side and the secondary side of the balance transformer 224(7) is used as the reference node d. Moreover, the number of the first impedance devices of the determining unit 231 is not the same as the number of the lamps.

Second Embodiment

Figure 4:
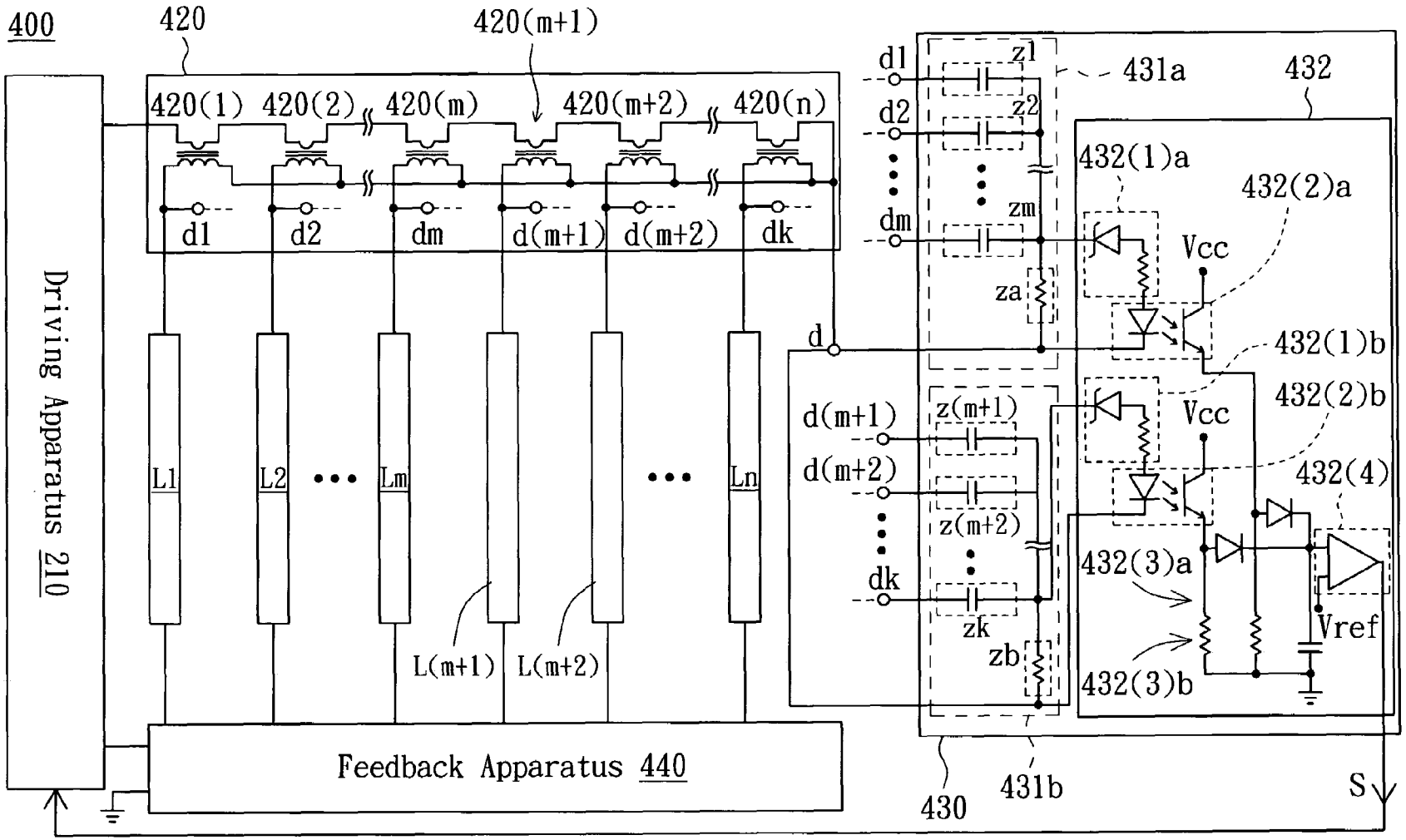
FIG. 4 is a circuit diagram of a multi-lamp driving system according to a second embodiment of the present invention.

Please referring to FIG. 4, a circuit diagram of a multi-lamp driving system according to a second embodiment of the present invention is illustrated in FIG. 4. The difference between the multi-lamp driving system 400 in FIG. 4 and the multi-lamp driving system in FIG. 3B is that the protection apparatus 430 includes two detection units 431*a* and 431*b*. The determining unit 432 includes two clippers 432(1)*a* and 432(1)*b*, two isolation circuits 432(2)*a* and 432(2)*b* and two peak detectors 432(3)*a* and 432(3)*b* correspondingly, which are coupled with the same input end of the comparator 432(4). Furthermore, the detection nodes d1~dk (k=n) are divided into two parts, d1~dm and d(m+1)~dk. M is a positive integer between 2 and k. As shown in FIG. 4, the detection units 431*a* and 431*b* are respectively coupled with the detection nodes d1~dm and d(m+1)~dk. Similar to the first embodiment, when one of the lamps L1~Lm malfunctions, the determining unit 432 performs the protection procedure according to the cross-voltage variation of the second impedance device za in the detection unit 431*a*. When one of the lamps L(m+1)~Ln malfunctions, the determining unit 432 performs the same protection procedure.

The present embodiment is used when the number of the lamps increases and the sensitivity of the cross-voltage variation of the second impedance device decreases. Therefore, another detection unit is for sharing part of the detection nodes. Of course, the detection nodes d1~dk can be divided into more parts, and more detection units are used accordingly in order to maintain or increase the sensitivity of the protection apparatus.

Third Embodiment

Figure 5:
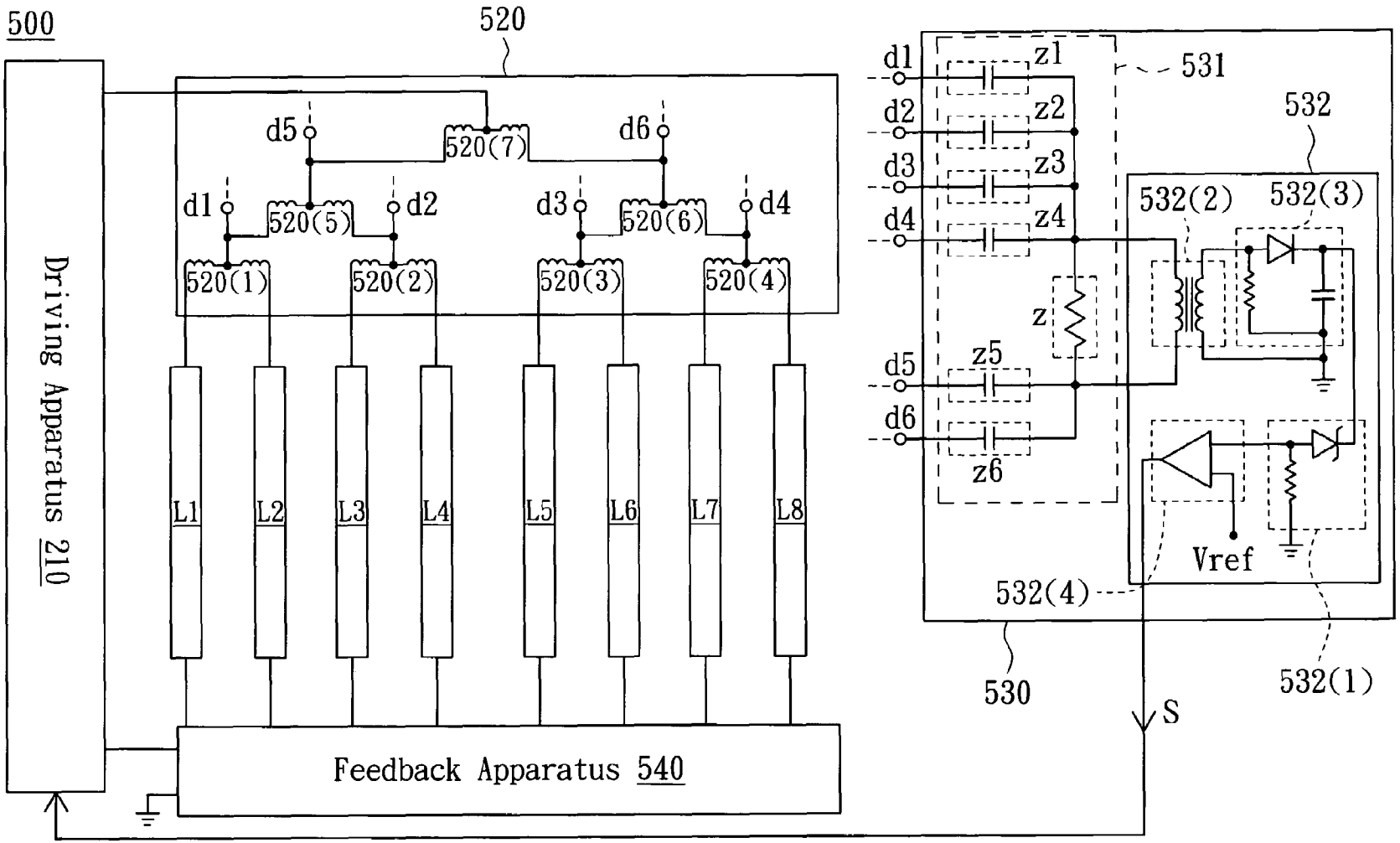
FIG. 5 is a circuit diagram of a multi-lamp driving system according to a third embodiment of the present invention.

Please referring to FIG. 5, a circuit diagram of a multi-lamp driving system according to a third embodiment of the present invention is illustrated in FIG. 5. The difference between the multi-lamp driving system 500 of the present embodiment and the multi-lamp driving system 200 in FIG. 3D is that there is no reference node in the present embodiment. The first ends of the first impedance device z1~z4 of the detection unit 531 are coupled with the detection nodes d1~d4 respectively. The first impedance devices z5 and z6 are coupled with the detection nodes d5 and d6 respectively. The second ends of the first impedance devices z1~z4 are coupled with the first end of the second impedance device z. The second ends of the first impedance devices z5 and z6 are coupled with the second end of the second impedance device z.

However, anyone who has ordinary skill in the field of the present invention can understand that the present invention is not limited to the above embodiments. For example, the protection apparatus of the present invention can be used when the current balancer is disposed at the low voltage end of the lamps (as a floating-type current balancer disclosed in European Patent No. 1,581,030). Furthermore, although the current balancer of the first embodiment includes the reference node, each first impedance device and the second impedance device can still be coupled according the embodiments. Moreover, similar to the second embodiment, the detection units in the third embodiment can be respectively coupled with the detection nodes in order to maintain or increase the sensitivity when the number of the lamp increases. Furthermore, the number and the location of the detection nodes are adjustable according to the type of the current balancer, the coupling method of the shunt and the reference node. When the capacitance is used as the impedance device, the impedance can be formed by the copper foil on a general circuit board for reducing the manufacturing cost.

In the protection apparatus and the multi-lamp driving system using the same according to the above embodiments, a general impedance device is used to replace to the high voltage diode. Even when the current balancer is disposed at the high voltage end of the lamps, the protection apparatus has much higher sensitivity than the conventional one in detecting the malfunctioning lamp. Therefore, the protection apparatus of the present invention decreases the manufacturing cost effectively and provides better protection for the multi-lamp driving system using the same.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A protection apparatus used in a multi-lamp driving system comprising a driving apparatus for driving a plurality of lamps and a current balancer for balancing the current flowing through each of the lamps, the current balancer comprising a plurality of detection nodes, the protection apparatus comprising:

at least a detecting unit comprising;

a plurality of first impedance devices, a first end of each impedance device coupled with the corresponding detection node; and a second impedance unit coupled with a second end of each first impedance device, wherein a cross-voltage between a first end and a second end of the second impedance device is a sum of the voltage level of the detection nodes coupled with the first impedance devices; and a determining unit coupled with the second impedance device of the at least one determining unit; wherein the determining unit outputs a protection signal to disable the driving apparatus when the determining unit determines at least one lamp malfunctions according to the cross-voltage between the first end and the second end of the second impedance device of the at least one detection unit.

2. The protection apparatus according to claim 1, wherein impedances of the first impedance devices are substantially the same, and each first impedance device is an inductance device, a capacitance device or a resistance device.

3. The protection apparatus according to claim 1, wherein the second impedance device is an inductance device, a capacitance device or a resistance device.

4. The protection apparatus according to claim 1, wherein the determining unit comprises an isolation circuit, and a high voltage side of the isolation circuit is coupled with the first end and the second end of the second impedance device.

5. The protection apparatus according to claim 4, wherein the isolation circuit is a photo coupler or an isolation transformer.

6. The protection apparatus according to claim 4, wherein the determining unit further comprises:

a comparator, two input ends of the comparator are respectively coupled with the low voltage side of the isolation circuit and a reference voltage, and the comparator outputs the protection signal when the level of the low voltage side of the isolation circuit larger than the reference voltage;

a peak detector coupled between the low voltage side of the isolation circuit and the comparator; and a clipper coupled between the high voltage side of the isolation circuit and the second impedance device or between the low voltage side of the isolation circuit and the comparator.

7. The protection apparatus according to claim 1, wherein the current balancer further comprises a plurality of balance transformers, and the detection node is at one end of a primary side or a secondary side of each balance transformer.

8. The protection apparatus according to claim 7, wherein a common node is on the primary side or the secondary side of the balance transformers, the second ends of the first impedance devices are coupled with the first end of the second impedance device, and the second end of the second impedance device is coupled with the common node.

9. The protection apparatus according to claim 7, wherein one of the balance transformers comprises a receiving end coupled with a driving signal of the driving apparatus, the second ends of the first impedance devices are coupled with the first end of the second impedance device, and the second end of the second impedance device is coupled with the receiving end.

10. The protection apparatus according to claim 7, wherein the second ends of part of the first impedance devices are coupled with the first end of the second impedance device, and the second ends of the other part of the first impedance devices are coupled with the second end of the second impedance device.

11. A multi-lamp driving system comprising:

a driving apparatus for driving a plurality of lamps;

a current balancer for balancing the current flowing through each of the lamps, the current balancer comprising a plurality of detection nodes; and a protection apparatus comprising:

at least a detection unit comprising:

a plurality of first impedance devices, a first end of each first impedance device coupled with the corresponding detection node; and a second impedance device coupled with a second end of each first impedance device, wherein a cross-voltage between a first end and a second end of the second impedance device is a sum of the voltage level of the detection nodes coupled with the first impedance devices; and a determining unit coupled with the second impedance device of the at least one detection unit; wherein the determining unit outputs a protection signal to disable the driving apparatus when the determining unit determines at least one lamp malfunctions according to the cross-voltage between the first end and the second end of the second impedance device of the at least one detection unit.

12. The system according to claim 11, wherein impedances of the first impedance devices are substantially the same, and each first impedance device is an inductance device, a capacitance device or a resistance device.

13. The system according to claim 11, wherein the second impedance device is an inductance device, a capacitance device or a resistance device.

14. The system according to claim 11, wherein the determining unit comprises an isolation circuit, and a high voltage side of the isolation circuit is coupled with the first end and the second end of the second impedance device.

15. The system according to claim 14, wherein the isolation circuit is a photo coupler or an isolation transformer.

16. The system according to claim 14, wherein the determining unit further comprises:

a comparator, two input ends of the comparators are respectively coupled with the low voltage side of the isolation circuit and a reference voltage, and the comparator outputs the protection signal when the level of the low voltage side of the isolation circuit larger than the reference voltage;

a peak detector coupled between the low voltage side of the isolation circuit and the comparator; and a clipper coupled between the high voltage side of the isolation circuit and the second impedance device or between the low voltage side of the isolation circuit and the comparator.

17. The system according to claim 11, wherein the current balancer further comprises a plurality of balance transformers, and the detection node is at one end of a primary side or a secondary side of each balance transformer.

18. The system according to claim 17, wherein a common node is at a primary side or a secondary side of the balance transformers, the second ends of the first impedance devices are coupled with the first end of the second impedance device, and the second end of the second impedance device is coupled with the common node.

19. The system according to claim 17, wherein one of the balance transformers comprises a receiving end coupled with a driving signal of the driving apparatus, the second ends of the first impedance devices are coupled with the first end of the second impedance device, and the second end of the second impedance device is coupled with the receiving end.

20. The system according to claim 17, wherein the second ends of part of the first impedance devices are coupled with the first end of the second impedance device, and the second ends of the other part of the first impedance devices are coupled with the second end of the second impedance device.

* * * * *